US006719287B2

(12) United States Patent
Henn

(10) Patent No.: US 6,719,287 B2
(45) Date of Patent: Apr. 13, 2004

(54) METHOD AND DEVICE FOR ALIGNING SHEETS

(75) Inventor: Andreas Henn, Neckargemünd (DE)

(73) Assignee: Heidleberger Druckmaschinen AG, Heidelberg (DE)

( * ) Notice: Subject to any disclaimer, the term of this patent is extended or adjusted under 35 U.S.C. 154(b) by 35 days.

(21) Appl. No.: 09/790,936

(22) Filed: Feb. 22, 2001

(65) Prior Publication Data

US 2001/0017443 A1 Aug. 30, 2001

(30) Foreign Application Priority Data

Feb. 22, 2000 (DE) ..... 100 07 996

(51) Int. Cl.[7] ..... B65H 3/28
(52) U.S. Cl. ..... 271/226; 271/228; 271/250
(58) Field of Search ..... 271/227, 228, 271/226, 250, 249, 252, 253

(56) References Cited

U.S. PATENT DOCUMENTS 4,613,125 A 9/1986 Jeschke
5,195,736 A * 3/1993 Ishidate ..... 271/228 X
5,267,728 A 12/1993 Simeth
5,443,257 A * 8/1995 Sakamori ..... 271/228
5,609,428 A * 3/1997 Tanaka et al. ..... 271/227 X

FOREIGN PATENT DOCUMENTS

DE 33 01 722 C2 7/1984
DE 41 16 409 C2 11/1992
DE 198 22 307 A1 1/1999

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

A method of aligning sheets prior to transferring them to a sheet-processing machine includes feeding a respective sheet, by a first sheet edge thereof, against a stop; gripping the sheet by at least one sheet holder, and displacing the sheet holder at least approximately transversely to the stop in a direction towards a first control region; and onwardly moving the sheet holder, while the sheet is held thereby, over a given first distance, after a second sheet edge has reached the first control region; and a device for performing the method.

4 Claims, 1 Drawing Sheet

METHOD AND DEVICE FOR ALIGNING SHEETS

BACKGROUND OF THE INVENTION

Field of the Invention

The invention relates to a method of aligning sheets prior to transfer thereof to a sheet-processing machine, and to a device for aligning sheets.

The published German Patent Document DE 198 22 307 A1 discloses a device of the foregoing general type having a sheet entrainer formed by a transporting roller, by the aid of which a sheet butting by a leading edge thereof against front lays can be displaced a predetermined distance transversely to a sheet travel direction until a side edge thereof strikes against side lays. It has been found that in-register alignment of the sheets cannot be assured in all cases, because the sheet can twist as it strikes against the side lays, with a consequent production of an aligning-error angle. It is also disadvantageous that the outlay for controlling the movement of the entrainer for displacing the sheet a precise distance is very high. Furthermore, a very large amount of construction space is required by the sheet entrainer.

SUMMARY OF THE INVENTION

It is accordingly an object of the invention to provide a method of the type mentioned in the introduction hereto with which in-register alignment of the sheets can be assured. A further object of the invention is to provide a device for aligning sheets, which is of relatively simple and straightforward construction.

With the foregoing and other objects in view, there is provided, in accordance with one aspect of the invention, a method of aligning sheets prior to transferring them to a sheet-processing machine, which comprises feeding a respective sheet, by a first sheet edge thereof, against a stop; gripping the sheet by at least one sheet holder, and displacing the sheet holder at least approximately transversely to the stop in a direction towards a first control region; and onwardly moving the sheet holder, while the sheet is held thereby, over a given first distance, after a second sheet edge has reached the first control region.

In accordance with another mode, the method of the invention includes gripping the sheet by the sheet holder, prior to transferring the sheet to the machine, and displacing the sheet holder in the direction towards the stop and, after the first sheet edge has passed a second control region, moving the sheet holder, while it holds the sheet, onwards over a given second distance.

In accordance with a further mode, the method of the invention includes previously displacing the stop into a neutral position before the sheet travels over the second distance.

In accordance with an added mode, the method of the invention includes displacing the stop into a neutral position as the sheet travels over the second distance.

In accordance with an additional mode, the distance covered, after the control region has been reached, is the same for all sheets.

In accordance with yet another mode, the first sheet edge is the leading sheet edge, and the second sheet edge is a lateral sheet edge.

In accordance with yet a further mode, the method of the invention includes securing the sheet by a first sheet holder as the sheet travels over the first distance, securing the sheet by a second sheet holder as the sheet travels over the second distance, and releasing the sheet from the first sheet holder before the sheet is received by the second sheet holder.

In accordance with yet an added mode, the method of the invention includes securing the sheet by the second sheet holder until a feeder system of the machine has received the sheet.

In accordance with yet an additional mode, the method of the invention includes maintaining the sheet at a standstill as it is transferred from the first sheet holder to the second sheet holder.

In accordance with still another mode, the method of the invention includes maintaining the sheet at a standstill as it is transferred from the second sheet holder to the feeder system.

In accordance with still a further mode, the method of the invention includes maintaining the sheet at a standstill as it is transferred from the first sheet holder to the second sheet holder, and from the second sheet holder to the feeder system.

In accordance with another aspect of the invention, there is provided a device for aligning sheets prior to transferring them to a sheet-processing machine, having at least one actuating system including at least one sheet entrainer, comprising an actuating drive for displacing the entrainer, said actuating drive being a piezoelectric micro-thrust drive.

In accordance with another feature of the invention, the sheet entrainer is selected from the group thereof consisting of pneumatic and mechanical sheet entrainers.

In accordance with a further feature of the invention, the aligning device includes a stationary sheet-detection device for detecting the position of an individual sheet displaced by the actuating system.

In accordance with a concomitant feature of the invention, the sheet-detection device has at least one position detector selected from the group thereof consisting of contact-free operating and mechanical position detectors.

In order to achieve the objective of the invention, a method is proposed which provides that the sheet which is to be aligned be initially guided, by way of a first sheet edge, against a stop. Then the sheet is gripped, i.e., held or retained, by at least one displaceable sheet holder or retainer and displaced due to a displacement of the sheet retainer transversely, or approximately transversely, to the stop in a direction towards a first control region. As soon as a second sheet edge of the sheet has reached the first control region, the sheet holder, while holding the sheet, is moved on over a given first distance. This completes the aligning operation, and the sheet can be transported farther to the sheet-processing machine. The alignment of the sheet thus takes place in two steps, wherein, in a first step, the first sheet edge, for example, the leading sheet edge, is aligned in accordance with the sheet travel direction with the aid of the stop and, in a second step, the sheet is displaced into the desired position by way of the second sheet edge thereof, i.e., one of the lateral sheet edges, without being positioned against a stop in the process. It is thus possible to rule out twisting of the sheet and to ensure in-register alignment. In another modification or variant, the first sheet edge is one of the lateral sheet edges, i.e., the latter is advanced up to the stop and aligned, and the leading sheet edge is positioned correspondingly without the aid of a stop.

A development of the invention provides that the sheet, prior to its transfer to the machine, be gripped by a sheet holder, and the sheet holder, together with the sheet, be displaced in the direction towards the stop and, after the first sheet edge has passed a second control region, the sheet holder, while holding the sheet, be moved on over a given second distance. After the sheet has been aligned, it is thus displaced, in dependence upon the alignment of the stop, in the sheet travel direction, or transversely to the sheet travel direction, into a transfer position, wherein the sheet can be received by a feeder system of the machine, for example, a gripper system. In order that the sheet does not strike against the stop in the process, an advantageous modification or variant provides that the stop be displaced into a neutral position as the sheet travels over the second distance. After the sheet has been aligned, the sheet, rather than being displaced against the stop again, is held by the sheet holder, which displaces the sheet into the desired transfer position.

An advantageous embodiment of the method provides that the first distance and/or the second distance be the same for all sheets. The sheets are thus all displaced always over the same, predetermined or fixed distance, which allows precise and reproducible alignment of the sheet in the sheet travel direction and/or in relation to the guiding and the drive side of the machine.

In a particularly advantageous embodiment of the method, the sheet, as it travels over the first distance, is secured by a first sheet holder and, as it travels over the second distance, is secured by a second sheet holder, the first sheet holder releasing the sheet before it is received by the second sheet holder. Because use is made of two sheet holders, which can preferably be displaced independently of one another, it is possible to realize a linear guidance of the sheet holders, respectively, which simplifies the construction of the device. Another embodiment provides at least one sheet holder which can be displaced both in the direction towards the first control region and in the direction towards the second control region. It is thus possible here to use one and the same sheet holder in order to align the sheet in the sheet travel direction and laterally.

According to a further mode of the method, the sheet is secured by the second sheet holder until a feeder system of the machine has received the sheet. This makes it possible to ensure that the sheet is not displaced as it is received by the feeder system.

Finally, a preferred mode of the method is one which is distinguished in that the sheet is at a standstill as it is transferred from the first sheet holder to the second sheet holder and/or from the second sheet holder to the feeder system. This ensures that the sheet does not move relative to the sheet holder and/or to the feeder system as it is transferred. It is thus possible to rule out twisting or displacement of the sheet which has already been aligned.

In order to achieve the objective of the invention, an aligning device is also proposed which comprises at least one actuating system having at least one sheet entrainer which can be displaced with the aid of an actuating drive. The aligning device is distinguished in that the actuating drive is a piezoelectric micro-thrust or micro-push drive. In comparison with conventional actuating drives, the micro-thrust drive is considerably smaller, and takes up considerably less space. Furthermore, the distances by which the actuating drive displaces the sheet entrainer can be set very precisely. This makes it possible to ensure a precisely positioned, reproducible alignment of the sheets, for example, on a feeding table. The construction of the piezoelectric micro-thrust drive is identical to the piezoelectric micro-thrust drive described in the article entitled "Piezoelektrischer Mikrostoβantrieb" [Piezoelectric micro-thrust drive], Feinwerktechnik & Messtechnik (F&M) 106 (1998), pages 212 to 217, Carl Hansa Verlag, Munich, the contents of which form part of the subject matter of this description.

In an advantageous exemplary embodiment of the aligning device according to the invention, the at least one sheet entrainer has a pneumatic or mechanical sheet holder. The sheet holder may thus be formed, for example, by a sucker or a sucker arrangement or by a gripper or a gripper system. The important factor is that the sheet can be reliably fixed and held or retained with the aid of the sheet holder, with the result that, during a displacement of the sheet holder, it is possible to rule out twisting or displacement of the sheet in relation to the sheet holder. This makes it possible to realize precise positioning of the sheet without requiring stops for this purpose, as in the case of the devices heretofore known in the prior art.

Particularly preferred is an exemplary embodiment of the aligning device having a stationary sheet-detection device, by the aid of which it is possible to detect the position of an individual sheet displaced by the actuating system. The sheet-detection device preferably signals the piezoelectric micro-thrust drive when the second sheet edge has passed the first control region and/or the first sheet edge has passed the second control region. The micro-thrust drive then displaces the sheet entrainer and/or the sheet holder over a given, adjustable distance, which is preferably the same for all the sheets, for example, of a sheet pile.

In a preferred embodiment, the sheet-detection device has at least one position detector having a contact-free operation or a mechanical operation. The position detector operating contact-freely may be formed, for example, by a switch based on optical waveguides, a light barrier, ultrasonic sensors or the like. All modifications or variants of the position detector have in common the fact that, when the sheet is detected by the stationary position detector, the piezoelectric micro-thrust drive is activated at this moment in time, the drive displacing the sheet-holding entrainer over a predetermined distance, which is preferably always the same.

Other features which are considered as characteristic for the invention are set forth in the appended claims.

Although the invention is illustrated and described herein as embodied in a method and device for aligning sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
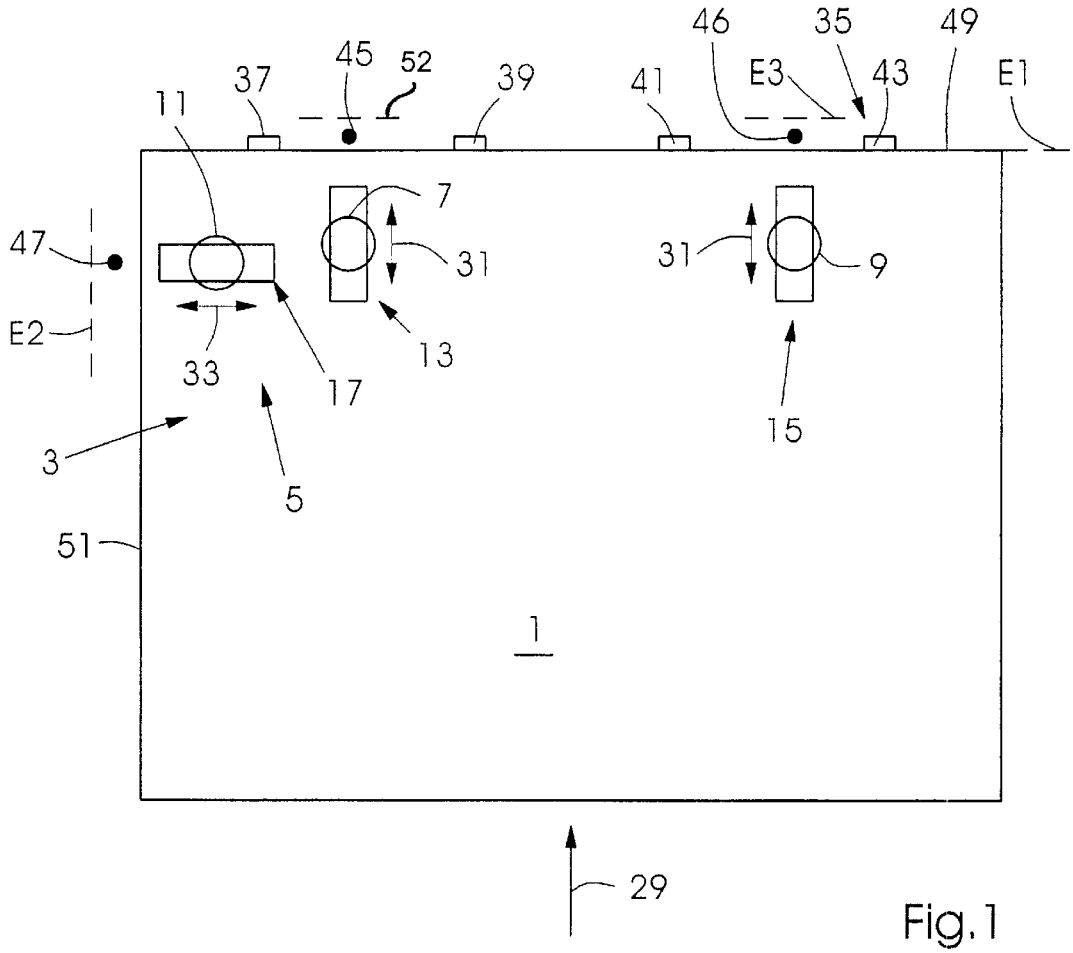
FIG. 1 is a diagrammatic and schematic plan view of an exemplary embodiment of a feeder of a sheet-processing machine incorporating the invention.

Referring now to the drawings and, first, particularly to FIG. 1 thereof, there is shown therein, in a plan view, a feeder, which is otherwise not illustrated in greater detail, for a sheet-processing machine, for example a sheet-printing machine. A device 3 including an actuating system 5 is provided for in-register alignment of a sheet 1 which is lifted off a non-illustrated sheet pile. The actuating system 5 has first sheet entrainers 7 and 9 and a second sheet entrainer 11, each of which is formed as a sheet holder in this exemplary embodiment. The term "sheet holder" is thus to be understood as covering all devices by which the sheet 1 is retained and fixed and, during displacement of the sheet entrainers, is entrained thereby. Purely by way of example, it is assumed hereinbelow that the sheet entrainers 7, 9, 11, respectively, have a sucker of which the construction and function are conventionally known, so that there is no need for any more detailed description. In another non-illustrated exemplary embodiment, the sheet entrainers 7, 9, 11, respectively, are formed by a gripper or gripper system.

In the exemplary embodiment illustrated in FIG. 1, the first sheet entrainers 7 and 9 are displaceable parallel to the sheet travel direction 29, as is indicated by double-headed arrows 31. The second sheet entrainer 11 is displaceable transversely to the sheet trave direction 29, as is indicated by a double-headed arrow 33. The sheet entrainers 7, 9 and 11. Respectively, are coupled to a dedicated actuating drive 13, 15 and 17, respectively, which are not illustrated in great detail, inasmuch as they are conventional piezoelectric micro-thrust drives.

Figure 2:
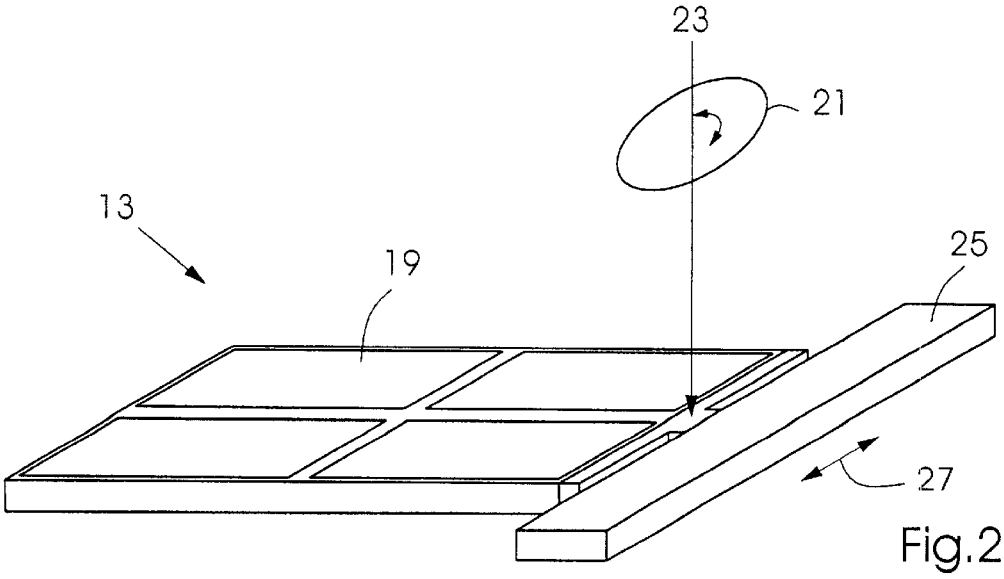
FIG. 2 is a fragmentary top, front and side perspective view of an exemplary embodiment of an actuating drive for a sheet entrainer forming part of the invention.

The operating or functional principle of a piezoelectric micro-thrust drive is explained in greater detail hereinbelow with reference to FIG. 2. The micro-thrust drive has a dual-mode piezoresonator 19 which, during activation of one of the diagonally connected electrode pairs and of a rear counter-electrode, is made to oscillate with an alternating current voltage, as a result of which an elliptical movement contour 21 is produced. This movement of the piezoresonator 19 is transferred by friction, with the aid of a transmission element 23, to a linearly guided guide element 25, which can be coupled to the sheet entrainer which is not illustrated in FIG. 2. The guide element 25 can be displaced in the direction of the double-headed arrow 27 with the aid of the piezoresonator 19. The direction of circulation of the ellipse, and thus the direction of movement of the micro-thrust drive, can be alternated by changing the phase position of the mechanical oscillations, produced by the alternating current voltage, relative to one another. The piezoelectric micro-thrust drive described with reference to FIG. 2 can be used to realize translation speeds up to 1 m/s or more of the guide element 25.

Provided in the feeder is a stop 35 which, in this exemplary embodiment, is formed by front lays 37, 39, 41 and 43, of which the stop surfaces are located in a common, imaginary plane E1. Arranged between the front lays 37, 39 and the front lays 41, 43 are sheet-detection sensors 45 and 46, respectively, which, as viewed in the sheet travel direction 29, are arranged behind the front lays 37 to 43, in a second control region. Further sheet-detection sensors 47 are arranged to the side of the sheet 1, opposite the second sheet entrainer 11, in a first control region. The sheet-detection sensors 45, 46, 47 are part of a sheet-detection device which cooperates with the actuating drives 13, 15, 17, which are discussed hereinafter in greater detail.

The operation or functioning of the device 3 is explained in greater detail hereinbelow: initially, the sheet 1 is positioned by the leading edge 49 thereof against the front lays 37 to 43. In this case, the leading edge 49 is aligned roughly in the peripheral direction (sheet-transporting direction). Then the sheet 1 is gripped, i.e., in this exemplary embodiment, attached by suction and fixed, by the second sheet entrainer 11. Then the sheet entrainer 11 is displaced, by the actuating drive 17, transversely to the sheet travel direction 29 in the direction of the first control region, wherein the sheet-detection sensors 47 are located. After the side edge 51 of the sheet 1 which is directed towards the sheet-detection sensors 47 has been detected by the sheet-detection sensors 47, the actuating drive 17 further displaces the second sheet entrainer 11, together with the sheet 1, a predetermined first distance, in the same direction, until a standstill position is reached. In this lateral position wherein the sheet 1 is now found, the side edge 51 of the sheet is located in an imaginary, second plane E2, which runs parallel to the sheet travel direction 29. The second sheet entrainer 11 then releases the laterally aligned sheet 1. Thereafter, the sheet 1 is gripped by the first sheet entrainers 7, 9, the front lays 37 to 43 are moved away into a neutral position, wherein they are not in contact with the sheet 1, and the first sheet entrainers 7, 9 are displaced, with the aid of the actuating drives 13, 15, in the direction of the second control region, wherein the sheet-detection sensors 45, 46 are located, beyond the front lays 37 to 43.

After the leading edge 49 of the sheet 1 has been detected by the sheet-detection sensors 45, the latter give the actuating drive 13 a signal. The instant the leading sheet edge 49 is detected by the sheet-detection sensors 46, the latter signal the actuating drive 15 in order to activate it correspondingly. The sheet 1 is then moved on farther a predetermined second distance by the actuating drive 13, 15. In this case, the sheet 1 assumes a position, in the sheet travel direction 29, wherein the leading edge 49 thereof is aligned transversely to the sheet travel direction 29, as is indicated by broken lines 52. The first sheet entrainers 7, 9 preferably secure the sheet 1 until a non-illustrated feeding system of the machine, for example, a gripper bar of the pre-gripper, has gripped the sheet. Then the first sheet entrainers 7, 9 release the sheet 1 and, in the same way as for the second sheet entrainer 11, are displaced back into the starting position thereof.

It is obvious from what has been noted hereinabove that the actuating drives 13, 15 operate independently of one another and displace the sheet farther only a defined or predetermined distance when they receive a signal from the respective sheet-detection sensors, i.e., when the actuating drive 13 receives a signal from the sheet-detection sensors 45, and the actuating drive 15 receives a signal from the sheet-detection sensors 46. In other words, if the sheet is advanced obliquely up to the sheet-detection sensors 45, 46 and the leading sheet edge is detected, for example, first of all by the sheet-detection sensors 45, the actuating drive 13 thus begins to displace the sheet farther the desired second distance even before the sheet-detection sensors 46 have detected the leading sheet edge and have given a signal to the actuating drive 15. In this case, the signal transmission thus takes place with a time delay, it being possible to realize a desired alignment accuracy of the sheet due to the predetermined, constant second distance for the two actuating drives 13, 15.

In a further non-illustrated exemplary embodiment, only a first sheet entrainer is provided, due to which it is possible to simplify the construction of the actuating system 5. Of course, it is also possible to realize an actuating system with more than two first entrainers and/or with a second sheet entrainer or more than two second sheet entrainers.

It should be noted that it is only for aligning the leading sheet edge 49 transversely to the sheet travel direction 29 that a stop is required, whereas no stop is necessary for the lateral alignment of the sheet 1. This means that the situation wherein the sheet 1 twists or is displaced, as is the case with the conventional aligning devices, when the sheet is moved by a lateral edge thereof against a stop, can be reliably avoided. The device 1 can be used to realize the method according to the invention, which allows in-register alignment of an individual sheet, and precise positioning of the latter at a transfer location after the sheet has already been aligned.

I claim:

1. A device for aligning a sheet having a first sheet edge and a second sheet edge prior to transferring the sheet to a sheet-processing machine, the device comprising:

at least one displaceable sheet entrainer with an actuating drive, said actuating drive being a piezoelectric micro-thrust drive;

at least one stop for aligning the first sheet edge; and a control region for capturing the second sheet edge.

2. The aligning device according to claim 1, wherein said sheet entrainer is selected from the group thereof consisting of pneumatic and mechanical entrainers.

3. The aligning device according to claim 1, including a stationary sheet-detection device for detecting the position of an individual sheet displaced by said actuating drive.

4. The aligning device according to claim 3, wherein said sheet-detection device has at least one position detector selected from the group thereof consisting of contact-free operating and mechanical position detectors.

* * * * *